United States Patent [19]

Koch

[11] Patent Number: 4,581,992

[45] Date of Patent: Apr. 15, 1986

[54] SCREW PRESS FOR MECHANICALLY SEPARATING LIQUIDS FROM MIXTURES OF LIQUIDS AND SOLIDS

[75] Inventor: Klaus Koch, Laatzen, Fed. Rep. of Germany

[73] Assignee: Hermann Berstorff Maschinenbau GmbH, Hannover, Fed. Rep. of Germany

[21] Appl. No.: 319,895

[22] Filed: Nov. 10, 1981

[30] Foreign Application Priority Data

Nov. 15, 1980 [DE] Fed. Rep. of Germany ..... 3043194

[51] Int. Cl.[3] ..... B30B 9/14; B30B 9/18

[52] U.S. Cl. ..... 100/117; 100/148; 100/150; 366/90

[58] Field of Search ..... 100/37, 117, 145, 146, 100/147, 148, 149, 150, 93 S; 366/77, 90

[56] References Cited

U.S. PATENT DOCUMENTS

| | | | |
|---|---|---|---|
| 1,333,249 | 7/1918 | Fiddyment . | |
| 3,230,865 | 1/1966 | Hibbel et al. | 100/37 |
| 3,478,679 | 11/1969 | Bauserman | 100/150 X |
| 3,862,594 | 1/1975 | Stolting | 100/145 X |
| 4,024,168 | 5/1977 | Homann et al. . | |
| 4,199,263 | 4/1980 | Menges et al. | 366/90 |

FOREIGN PATENT DOCUMENTS

| | | | |
|---|---|---|---|
| 554916 | 7/1932 | Fed. Rep. of Germany | 100/117 |
| 1846103 | 2/1962 | Fed. Rep. of Germany . | |
| 2456187 | 11/1974 | Fed. Rep. of Germany . | |
| 579895 | 9/1976 | Sweden | 100/117 |
| 737446 | 6/1980 | U.S.S.R. | 100/117 |

*Primary Examiner*—Peter Feldman

*Attorney, Agent, or Firm*—Schwartz, Jeffery, Schwaab, Mack, Blumenthal & Koch

[57] ABSTRACT

A screw press for extracting liquids from liquid-solid mixtures continuously and in a single operation. The press comprises a barrel divided into a feed section and a pin-barrel section. A rotatable screw is disposed in the barrel. Grooves are provided in the feed section to ensure a good feed input and hence an economical throughput, the pin-barrel section including radial pins extending into the barrel which, together with the rotation of the screw cause a high pressure to build up in the barrel thereby comminuting the mixture. The screw has helical flights formed thereon, the flights defining ridges, radial bores being formed in the ridges which communicate with an axial bore formed in the screw permitting the draining away the extracted liquid directly from the region in which it is extracted.

13 Claims, 8 Drawing Figures

SCREW PRESS FOR MECHANICALLY SEPARATING LIQUIDS FROM MIXTURES OF LIQUIDS AND SOLIDS

The present invention relates to a device for mechanically separating liquids from mixtures of liquids and solids in a screw press. Screw presses are known in which a bottom filter is disposed opposite an inlet opening for the mixture provided in the cylindrical barrel for the screw, and also in which an outlet opening in the barrel is capable of being sealed by means of a pressure-loaded cone.

Filters of very varied types, such as centrifuges, vibration sieves, screw-presses and filter presses are known for mechanically separating liquids from mixtures of liquids and solids. Basically, there are different methods of effecting the separation. Thus, one can rely simply on the effect of gravity on the mixture or the mixture may be sheared or subjected to pressure. The liquid extraction effect which may be achieved solely by gravitational action or by the application of a shearing force is relatively small. However, by using a combination of applying pressure and, simultaneously, a shearing force, better extraction of the liquid is possible.

A device of this type is disclosed in U.S. Pat. No. 3,230,865. In such specification, there is disclosed a screw press in which the mixture is subjected both to a shearing force and to a pressure, the latter being regulatable by means of a cone which seals the outlet for the material.

Experiments have shown that the separation of liquid and solid mixtures utilising such a screw press is often inadequate due to the fact that only a relatively low pressure can be applied through the filter element, which element is usually cylindrical.

The present invention seeks to provide a separating device which permits liquids to be separated from mixtures of liquids and solids such that the resultant solid has a dry-substance content in excess of 95% and in which the separation is effected continuously in a plurality of stages in a single device.

In addition, the present invention seeks to provide a device which can be used in different environments such as for effecting separation of pumpable waste materials and for extracting liquid from paper pulp, beet leaves and beet slices.

The invention further seeks to provide a device which, with minor modification, can be utilised to obtain solids having any desired dry-substance content.

SUMMARY OF THE INVENTION

According to the present invention, there is provided a screw press for mechanically separating liquids from mixtures of liquids and solids, the rotatable screw being located within a cylindrical barrel, the barrel being provided with a material inlet opening and an outlet opening, a bottom filter being disposed opposite the inlet opening and the outlet opening being sealable by a pressure-loaded cone, the press comprising a feed section and a pin-barrel section, wherein grooves are formed in the internal surface of the barrel in the feed section, the pin-barrel section being disposed downstream of the feed section in the direction of travel of the mixture, a plurality of pins being provided in the pin-barrel section, the pins extending radially through the barrel and being directed towards the axis of rotation of the screw, the screw including helical flights extending outwardly from the screw core, the flights being interrupted, the axial spacing between adjacent ends of the flights in the interrupted region corresponding to the diameter of the pins, the screw having an axial bore formed therein, the axial bore communicating with radial bores directed towards the screw axis and formed in the ridges of the flights.

Because of the provision of grooves in the feed section, an economically viable rate of material feed into the device is achieved. This is because the grooves prevent the material from rotating with the screw. Optimum conveying conditions, and consequently a satisfactory material feed, are only achieved if the frictional resistance of the internal surface of the barrel of the screw is high. Accordingly, grooves are provided.

A first compression of the material occurs in the feed section. The liquid is released and extracted during the compression and flows away through the bottom filter of the feed section. The feed section therefore causes liquid to be removed, which liquid may be removed at a relatively low pressure.

The grooves in the feed section cause the extracted liquid to be conducted to the filter openings.

The partially extracted material then enters the pin-barrel section. A high pressure of up to 30 bars may build up in this section. The material is subjected, in the pin-barrel section, to an intensive conveying action by the helical flight portions located between the pins. The conveying action is intensified by the action of the pins extending into the interior of the barrel. This is because the pins prevent the material from rotating with the screw.

Because of the intense conveying action, a high pressure builds up in the pin-barrel section. This high pressure causes the cells of the material to be destroyed and, consequently, the water contained in the cells is extracted. Further liquid extraction from the material therefore occurs in the pin-barrel section.

To permit the extracted water to be removed from the interior of the device, particularly from the pin-barrel section, radial bores are formed in the ridges of the flights on the screw. These bores extend towards the axis of rotation of the screw and communicate with an axial bore formed in the screw. Because a high pressure prevails in the pin-barrel section, the extracted liquid is forced, by the flight ridges, into the radial bores and into the axial bore. From the axial bore, the liquid can be transferred into a collection vessel.

The gap between the flight ridges and the internal wall of the barrel is so dimensioned, that only very thin solid components can pass therethrough. This effectively prevents the radial and axial bores becoming blocked. Any solid components which do pass into the gap between the flight ridges and the internal wall of the barrel are pulverized by the rotation action of the screw and so are of a size which is too small to block the radial and axial bores. Moreover, such components are automatically removed from the gap between the flight ridges and the internal wall by means of the liquid which has been separated, due to the high pressure prevailing in the pin-barrel section. The greater the size of the gap, the greater the diameters of the axial and radial bores must be in order to ensure that the liquid discharge occurs in an efficient manner.

Accordingly, in summary, the grooves in the feed section ensure an economical feed input, the design of the pin-barrel section causes a high extraction pressure to build up and this comminutes the extracted material mechanically, and the radial and axial bores in the screw causes the extracted liquid to be removed directly at the site where it is produced.

By using a device in accordance with the present invention, it is possible, for example, to extract a water from a dripping-wet paper pulp in a single continuous operation so that the solid content obtained at the end of the process represents 90% of the dry-substance content. Results obtained using conventional filter presses do not usually even approach this figure for reasons which will now be discussed.

If a screw filter press is used having conventional filter openings distributed over the entire inner barrel, the maximum pressure which can be applied is generally of the order of 3 bars. Any pressure would press the mixture of liquid and solid through the filter openings and, moreover, the water contained in the cells of the solid would not be extracted. Conversely, the maximum pressure which can be applied is insufficient to remove the water contained in the cells.

However, the mere addition of pin-barrel sections to such an arrangement does not greatly improve the liquid extraction because, although a higher pressure can be built up, it escapes through the filter openings in the barrel without causing the cell walls of the solid component to be destroyed and without achieving the release of the water contained therein.

It is believed that it is only by building up a high pressure, with the simultaneous provision of means for draining away the extracted liquid without causing the pressure to drop to any considerable extent, that it is possible to effect liquid extraction which ensures high dry-substance values in a single continuous operation.

Advantageously, the grooves formed in the internal surface of the barrel in the feed section extend axially, helically and in a direction corresponding to the inclination of the flights or helically in a direction opposite to the inclination of the flights, the grooves being square, triangular or rectangular in cross-section.

The shape of the grooves is selected in dependence upon the particle size of the material to be extracted. In an advantageous embodiment, the individual pins are combined to form pin planes, are disposed at regular intervals around the curved surface of the barrel and are adjustable with respect to their depth of extension into the interior of the barrel, at least the portions of the pins which extend into the barrel being round, quadrilateral or polygonal in cross-section. The adjustability of the pins permits the user to modify the output rate from the feed section and hence the pressure build-up in the pin-barrel section. The possibility of the pins being rectangular or polygonal in cross-section increases the pulping action of the pins. This is because the relative sharp edges of the pins are beneficial to the shearing effect produced on the solids.

If the mixture has a high liquid content, it is advantageous if a filter ring is disposed between the feed section and the pin-barrel section, the filter ring being formed of two half-portions, the rings portions having screw-threaded connecting flanges which are screw-threadedly connected to correspondingly threaded flange portions provided on the appropriate ends of the feed section and the pin-barrel section, filter openings being formed at regular intervals in the filter ring portion. The first, and more easily extractable, portion of the liquid is obtained in relatively large quantities, in such a case, simply by the material passing through the feed section. Such liquid is then conducted away directly through the filter ring portion. The remaining liquid, which is more difficult to extract, is extracted through the radial and axial worm bores formed in the pin-barrel section.

The axially, centrally divisible nature of the filter rings facilitates the cleaning thereof.

If the mixture is one in which the liquid is difficult to extract but it is still desired to effect the extraction continuously in a single operation, it is advantageous if the barrel comprises a plurality of filter ring portions each having filter openings, the filter ring portions alternating, in axial direction of the worm, with barrel portions which are free of filter openings.

This causes the build-up in pressure to be more gradual and accordingly the extraction to be effected more gradually. Further preferably, the filter openings formed in the filter ring portions are round at their inner or barrel end but taper outwardly so that the outer end diameter of the opening is up to five times the inner end diameter. Such an arrangement minimizes any possible blocking of the openings.

In order to enable the extracted liquid to flow back within one helically extending screw thread on the side of the flight which is not involved in conveyance, it is desirable if the screw is a single- or multi-threaded worm.

A further improvement in the efficiency of extraction may be achieved if grooves extending longitudinally along the ridges of the flights are provided, radially extending bores being formed in the longitudinally extending grooves, the radial bores being directed towards the axis of rotation of the screw and communicating with the axial bore in the screw. By providing such an arrangement, the liquid can reach the radial bores more quickly and hence more liquid per unit time is removed from the barrel. Moreover, because of the sweeping movement of the flights, more fluid is collected along the internal wall of the barrel, which liquid is conducted to the radial bores along the grooves.

In order to be able to comminute the extracted material, for example, in order to make it sprayable or friable, it is preferred if the pressure-loaded cone sealing the outlet opening is capable of being driven and is provided with axial or helical grooves on its conical external surface.

When extracting a very bulky material, such as beet leaves, it is desirable if the barrel and the screw, at least in the feed section taper conically inwardly in the direction of flow of material through the device. Such an arrangement provides an increased absorption volume.

In a preferred embodiment, the conically tapering barrel and screw in the feed section are disposed above a filter ring portion in turn disposed above a pin-barrel section, the lowermost portion of the screw located beneath the pin-barrel section being so designed as to cause a back-pressure to build up in the pin-barrel section.

BRIEF DESCRIPTION OF THE DRAWINGS

Various embodiments of the separation device of the present invention will be further described, by way of example, with reference to the accompanying drawings.

DESCRIPTION OF THE PREFERRED EMBODIMENTS

Figure 1:
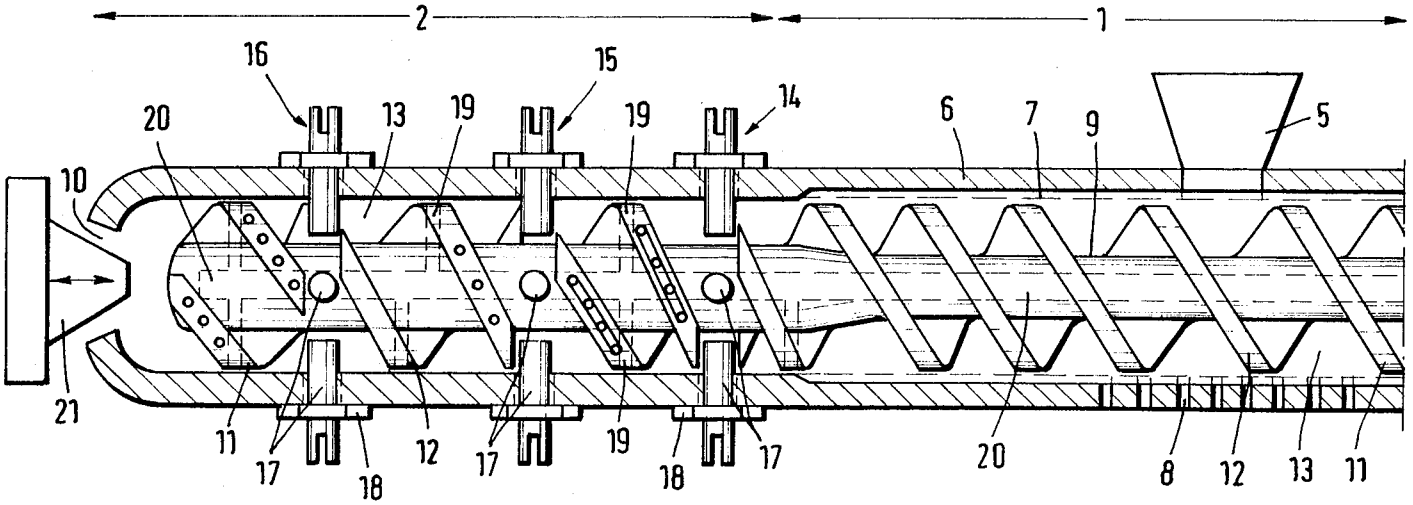
FIG. 1 is a diagrammatic longitudinal section through the one embodiment of a device in accordance with the present invention.

In FIG. 1, there is shown a screw device including a feed section which comprises a material feed hopper 5, a barrel 6 having axial grooves 7 and bottom filter openings 8 formed therein.

The screw 9 is disposed within the barrel 6 and is set in rotation by means of a drive unit (not shown). The screw then conveys the material to the outlet opening 10. Helical flights 11 and 12 are disposed around the core of the screw 9, and a screw thread 13 is defined between the flights.

The device further includes a pin-barrel section, generally referenced 2, in which the flights 11 and 12 are interrupted, the interruptions being dimensioned so as to correspond to the diameter of cylindrical pins 17 which are located in the spaces. Three pin planes 14, 15 and 16 are shown, each plane comprising individual pins 17 which extend towards the screw axis and are disposed at regular intervals around the curved surfaces of the barrel 6. The ends of the pins which extend into the cylinder may be cylindrical, rectangular or bevelled in cross-section so as to provide a cutting effect. The pins are screw-threadedly fitted into the barrel 6 and are retained in position by means of nuts 18.

Depending upon the nature of the material to be extracted, the depth to which the pins 17 extend into the barrel 6 may be adjusted simply once the nut 18 has been loosened. If, for example, all of the pins 17 are screwed deeply into the barrel, the material from which the liquid to be extracted is substantially prevented from rotating with the screw 9. Accordingly, the throughput of the screw increases considerably. With an increased throughput, pressure builds up considerably in the pin-barrel section 2, as does the extraction rate.

In order to ensure that, with the very high pressure of 30 bars and more which may build up in the pin-barrel section 2, the extracted liquid can be discharged through the liquid discharge openings without the pressure being reduced, radial bores 19 are formed in the ridges of the flights 11 and 12 in the pin-barrel section 2, which radial bores 19 communicate with an axial bore 20 formed in the screw 6.

The extracted liquid passes over the ridges of the flights 11 and 12 and, because of the high pressure extant in the pin-barrel section 2, quickly passes into the bores 19 and 20. The liquid is conducted away therefrom through further conduits (not shown).

In order to increase the pressure further, or to maintain it at a desired level, the outlet opening 10 of the device may be sealed by means of a drivable pressure-loaded cone 21. This automatically opens the outlet opening 10 when a pre-selected pressure is reached. The pressure at which the cone permits the passage of liquid through the opening 10 may be set in dependence upon the material being treated.

Figure 2:
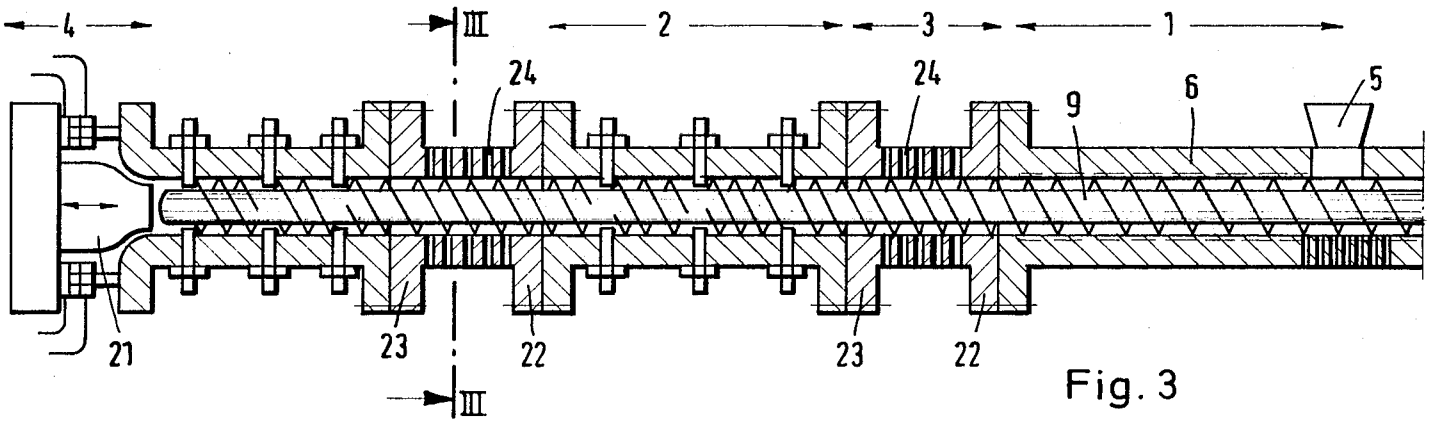
FIG. 2 is a diagrammatic longitudinal section through a second embodiment of a device in accordance with the present invention, such device including a plurality of filter rings and cylindrical pins disposed one behind the other in the direction of flow of the material.
Figure 3:
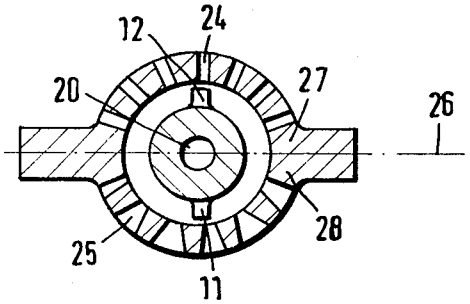
FIG. 3 is a cross-sectional view taken along the line III—III of FIG. 2 so as to show more clearly the filter openings in an exemplary filter ring.

A second embodiment of the invention is shown in FIG. 2 in which a filter ring section, generally referenced 3, is disposed between the feed section 1 and the pin-barrel section 2. The filter ring section 3 has screw-threaded flange members 22 and 23 which are connected to correspondingly threaded flange members provided on the appropriate ends of the feed section 1 and the pin-barrel section 2.

Filter openings 24, in the form of cylindrical bores, are formed in the sleeve of the filter ring section for the discharge of the extracted liquid. The filter openings may, if desired, be in the form of outwardly widening conical bores. In such a case, the outer end of the opening may be up to five times the size of the inner end thereof. The conical widening 25 of the filter openings counteracts any possible blocking of the opening.

The barrel may comprise a plurality of filter ring portions, each portion being formed in two parts which can be separated from one another along the line 26. The upper half 27 and the lower half 28 of each filter ring portion are screw-threadedly fitted together laterally and thus can be easily cleaned without the entire device having to be disassembled.

Figure 4:
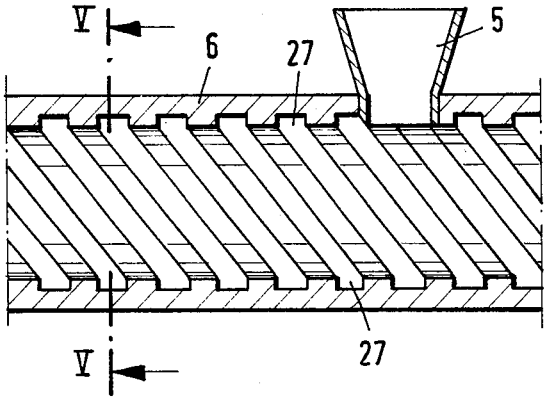
FIG. 4 is a longitudinal sectional view through a screw barrel forming part of the feed section of a device in accordance with the present invention and which has helically-formed, rectangular cross-sectional, grooves formed therein.

FIG. 4 shows a feed section of a screw press in which the barrel 6 has rectangular grooves 27 formed therein, the grooves 27 extending helically in the direction of the screw flights. These grooves are highly desirable if an economical feed capacity for the material to be extracted is to be achieved.

Figure 5:
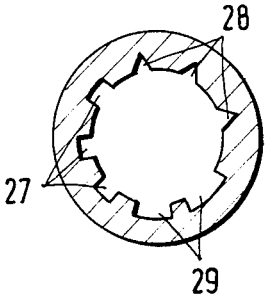
FIG. 5 is a cross-sectional view corresponding to a view taken along the line V—V of FIG. 4 but showing other cross-sections of the grooves in the barrel.

FIG. 5, which is effectively a partial section through the barrel 6 taken along the line V—V in FIG. 4, shows the grooves 27 in cross-section. In addition, FIG. 5 also shows grooves of other designs formed on the internal wall of the barrel 6 such as triangular grooves 28 and wide, rectangular grooves 29. The grooves 27, 28 and 29 may be formed in the internal wall of the barrel 6 both axially and helically and may extend in a counter-direction to the direction of the screw flights 11 and 12. This counter-disposition of the grooves is greatly beneficial in both the extraction and conveyance stages.

Figure 6:
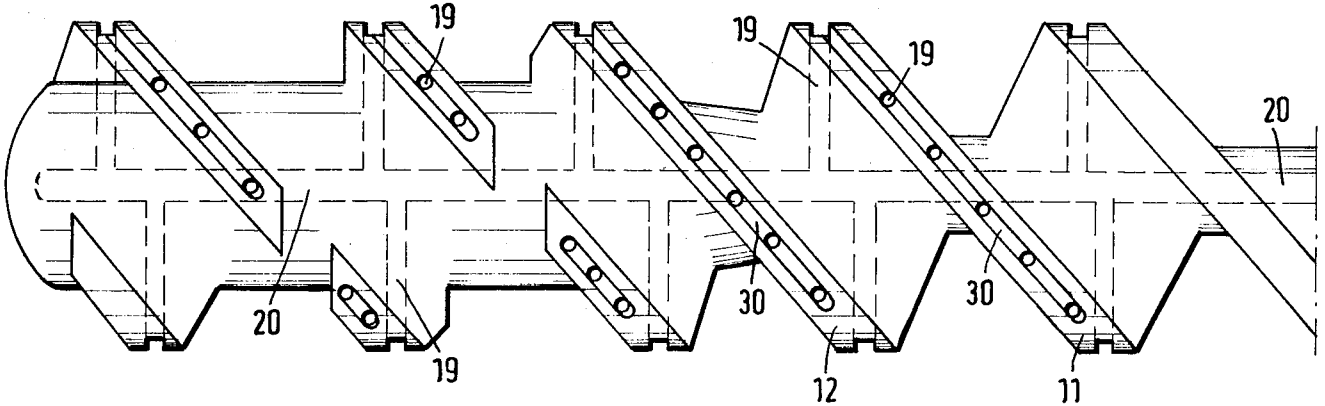
FIG. 6 is a longitudinal section through a screw device in accordance with the present invention which has a progressively increasing core diameter and has longitudinal grooves formed in the ridges of the flights of the screw.

FIG. 6 shows a screw 9 in which longitudinal grooves 30 are formed in the ridges of the screw flights 11 and 12. These grooves considerably facilitate the conduction of the liquid passing over the ridges of the flights to the radial bores 19. Since, during one revolution of the screw, the ridges of the flights sweep once over the entire inner surface of the barrel 6 thereby favouring the circumferential passage of the pressed-down liquid, and since the longitudinal grooves 30 in the flights collect the liquid and conduct it away through the bores 19 and 20, large quantities of liquid can be discharged in a short time without the pressure within the barrel 6 substantially reducing.

Figure 7:
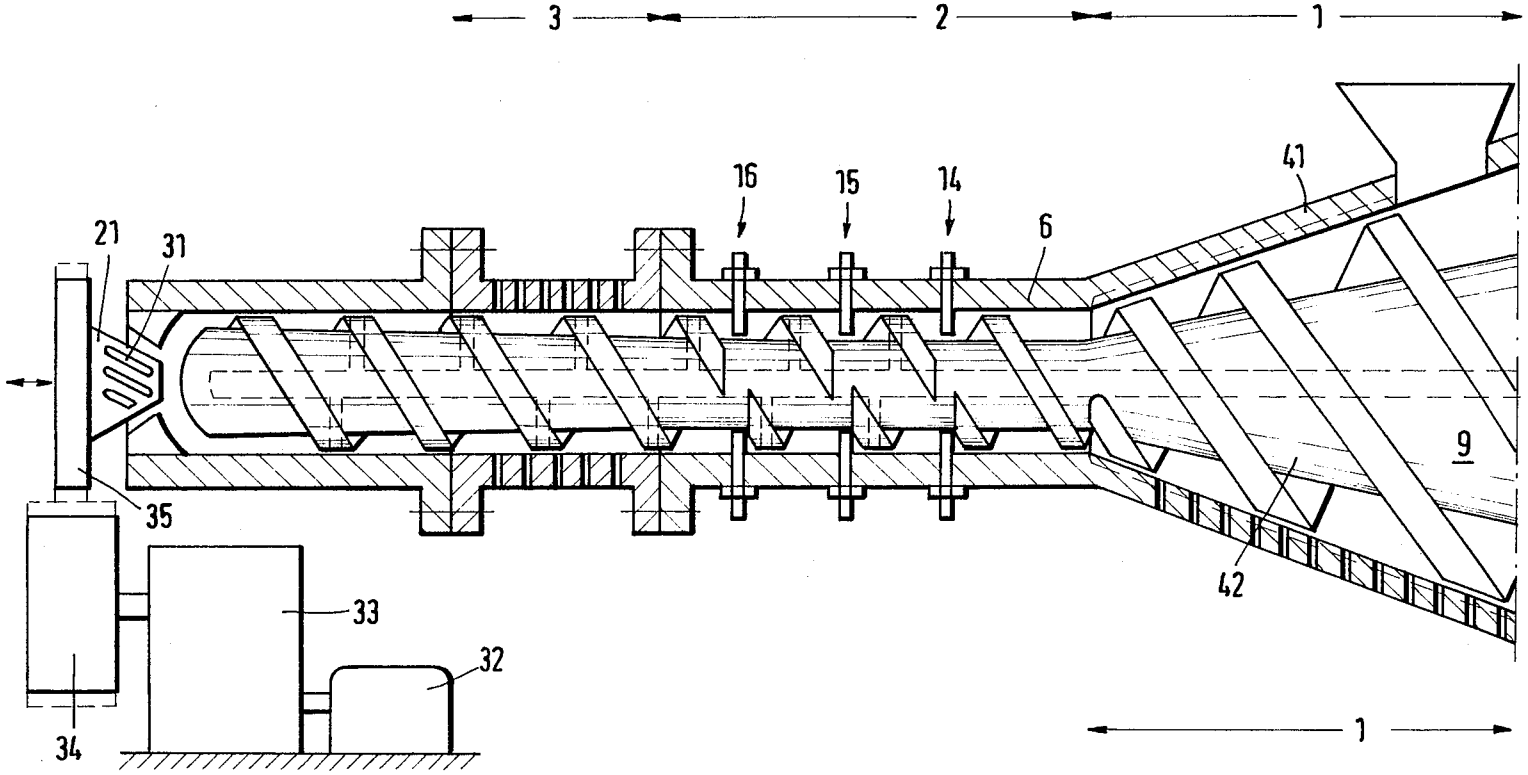
FIG. 7 is a longitudinal section through a conical feed section and a drivable, conical, sealing member forming part of a device in accordance with the present invention.

FIG. 7 shows a device having a feed section 1, wherein the barrel, now referenced 41 and the screw member 42 which rotates therein, are both conical in shape. Such a device is particularly suitable for the extraction of water from material which is in a very bulky state, such as, for example, beet leaves or slices, since the volume of such material is considerably reduced after a first extraction.

There is also shown, in FIG. 7, a drivable sealing cone 21 having grooves 31 formed in an outer sleeve portion thereof. A motor 32 drives the cone 21 through a transmission system 33 and toothed wheels 34 and 35. Strands of material which are in the grooves 31, are broken by the rotation of the cone, so that a granular, dried material is obtained which is friable or sprayable and can therefore be conveyed further in a satisfactory manner.

Figure 8:
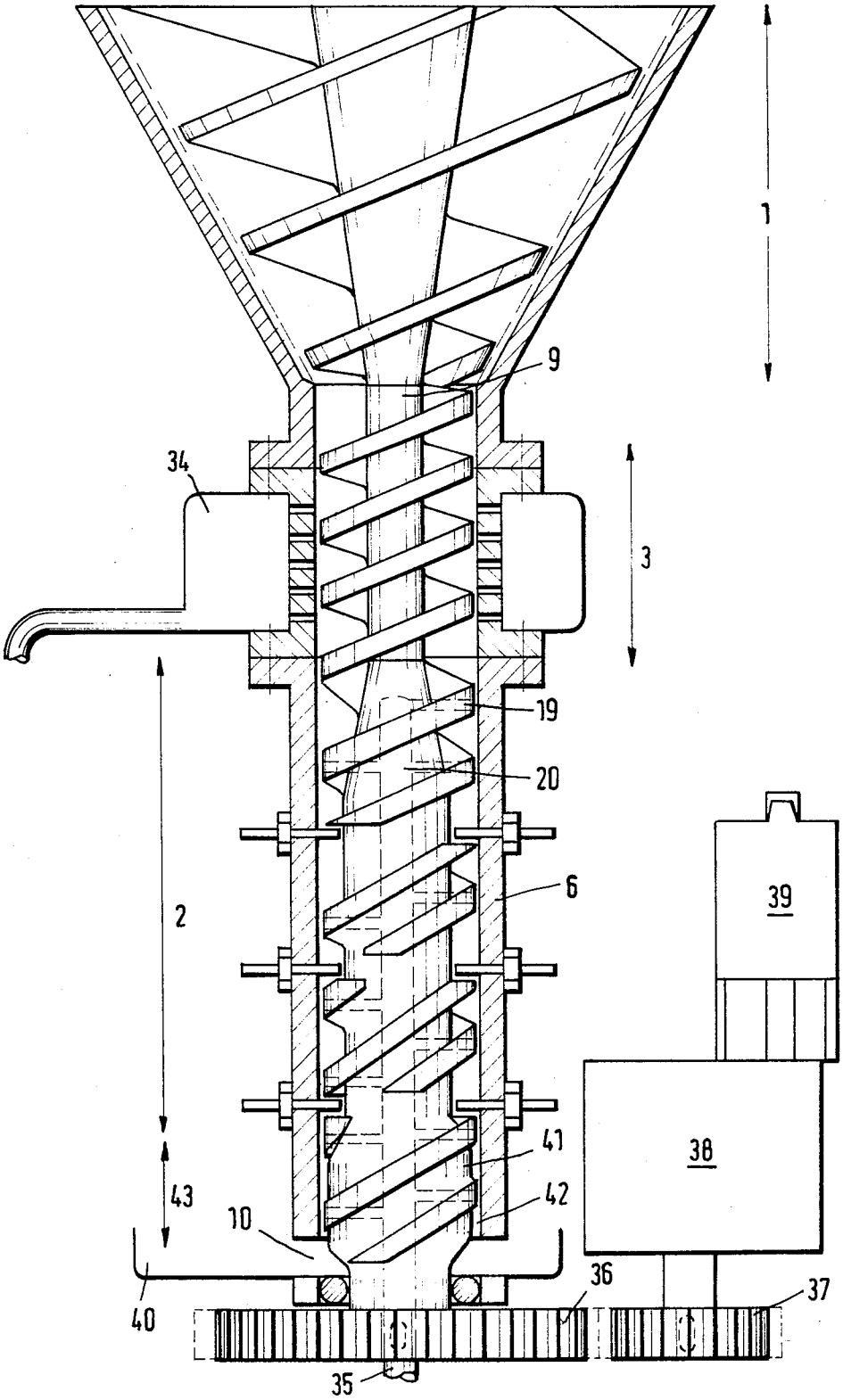
FIG. 8 is a longitudinal section through a vertically disposed device in accordance with the present invention, a drive unit therefor being shown diagrammatically.

FIG. 8 shows a separating device which is disposed vertically. By providing such an arrangement the feeding of the material to be extracted is considerably facilitated. Obviously, in such a case, the liquid cannot be discharged via a bottom filter and, accordingly a filter ring portion 3 is disposed between the feed section 1 and the pin-barrel section 2. A cylindrical liquid collection vessel 34 is disposed around the filter ring section 3.

The liquid which penetrates the radial and axial bores 19 and 20 can be caused to flow away satisfactorily by the provision of a downwardly-extending conduit 35. In such an arrangement the screw 9 is driven from the other end by means of toothed wheels 36 and 37, a transmission system 38 and a drive motor 39. The extracted solid material is collected in a vessel 40.

In this embodiment, in order to permit an adequate build-up of pressure in the barrel 6, the screw core 41 is considerably widened in the region of the outlet opening, so that only the annular space 42 between the core 41 and the internal wall of the barrel 6 is very small. If this space 42 becomes filled with extracted material, a back-pressure builds up. The desired back-pressure may be pre-selected by appropriately dimensioning the length of the widened portion of the screw core 41 and by appropriately dimensioning the gap between the core and internal wall of the barrel.

I claim:

1. A screw press for mechanically separating liquids from a solid-liquid mixture, comprising:

(a) a cylindrical barrel, (b) a rotatable screw mounted for rotation in said barrel, said screw having a base with an axial bore, and a helical flight and defining with said band a relatively low pressure feed zone in which material is fed through an inlet to the interior of the press, and a relatively high pressure pin-barrel mixing zone located downstream of said feed zone, said barrel being formed with internal grooves in said feed zone, (c) filter means disposed opposite said inlet in said feed zone for removing extracted liquid from the mixture under said low pressure conditions, (d) mixing pin means extending through said barrel in said pin-barrel mixing zone and being directed radially inward to a position adjacent the base of said screw, the helical flight of said screw being longitudinally interrupted in the area of said pin means to permit rotation of said screw, said helical flight in said mixing zone defining ridges closely adjacent the internal surface of said barrel so as to provide, in combination with said mixing pins, an area of high pressure, said ridges being formed with a plurality of radially inwardly directed bores which communicate with said axial bore in said screw to release the liquid extracted from the mixture under high pressure in the mixing zone, (e) means for maintaining the high pressure in said mixing zone, and (f) outlet means for the relatively dry solid product from which the liquid has been extracted.

2. Apparatus as recited in claim 1, wherein the direction of said grooves in said barrel in said feed zone either correspond to or is opposite from the direction of said helical flight means, the cross-section of said grooves being selected from square, rectangular and triangular.

3. Apparatus as recited in claim 1 wherein said mixing pin means are substantially equiangularly disposed around said barrel in longitudinally spaced pin planes, said mixing pin means being radially adjustable so as to vary the gap between said pins and the base of said screw, the portions of said mixing pin means extending into said barrel having a cross-section selected from round, quadrilateral and polygonal.

4. Apparatus as recited in claim 1 further including axially centrally divided filter ring means disposed intermediate said feed zone and said pin-barrel zone and connected thereto, said filter ring means defining a plurality of filter apertures disposed at regular intervals around said filter ring means.

5. Apparatus as recited in claim 4 wherein said barrel comprises a plurality of filter ring portions, said filter ring portions alternating with barrel portions not having filter apertures.

6. A device as recited in claim 4, wherein said filter apertures are conically shaped, with the circular cross-section at the outer end of each aperture being up to five times the diameter of said aperture at its radially inner end.

7. Apparatus as recited in claim 1, wherein said ridges of said helical flights are formed with grooves extending longitudinally in said ridges and communicating with said radial bores.

8. Apparatus as recited in claim 1, wherein said means for maintaining pressure in said mixing zone comprises a pressure-loaded cone means which opens said outlet when a preselected pressure is reached.

9. Apparatus as recited in claim 8, wherein said cone means is adapted to be driven and has an external surface defining additional grooves, the direction of said additional grooves being helical or axial.

10. Apparatus as recited in claim 1 wherein said barrel member and said screw, at least in said feed zone, taper conically inwardly in a direction of material conveyance and towards said mixing zone of said barrel.

11. Apparatus as recited in claim 1, wherein said barrel member and said screw are disposed vertically, and further including filter ring means, said filter ring positioned between said feed zone and said pin-barrel zone.

12. The apparatus of claim 11, wherein said means for maintaining the high pressure in said mixing zone comprises an increased diameter screw base adjacent said outlet means, consequently substantially reducing the space between said base and said barrel and correspondingly increasing and maintaining the higher pressure in said mixing zone.

13. The apparatus of claim 1, wherein said means for maintaining the high pressure in said mixing zone comprises an increased diameter screw base adjacent said outlet means, consequently substantially reducing the space between said base and said barrel and correspondingly increasing and maintaining the higher pressure in said mixing zone.

* * * * *